United States Patent [19]

Seely

[11] Patent Number: 4,509,714

[45] Date of Patent: Apr. 9, 1985

[54] PORTABLE WIND-RESISTANT SIGN STAND WITH FLEXIBLE BOW-TYPE LEGS

[75] Inventor: James R. Seely, Rochester, Mich.

[73] Assignee: Marketing Displays, Inc., Farmington Hills, Mich.

[21] Appl. No.: 513,852

[22] Filed: Jul. 14, 1983

[51] Int. Cl.[3] ..... G09F 1/00

[52] U.S. Cl. ..... 248/618; 40/602

[58] Field of Search ..... 248/632, 618, 560, 469; 40/602, 606, 608, 613

[56] References Cited

U.S. PATENT DOCUMENTS

| | | | |
|---|---|---|---|
| 1,598,438 | 8/1926 | Hallowell | 40/606 |
| 2,812,009 | 11/1957 | Skirvin | 248/618 |
| 2,845,111 | 7/1958 | Barecki | 248/618 |
| 3,494,057 | 2/1970 | Ford . | |
| 3,616,557 | 11/1969 | Vara, Sr. . | |
| 3,683,527 | 8/1972 | Gilman . | |
| 3,831,304 | 8/1974 | Miller et al. . | |
| 4,129,278 | 12/1978 | Bressler | 248/188.7 |
| 4,248,001 | 2/1981 | Feuvray . | |
| 4,309,836 | 1/1982 | Knapp | 40/602 |

FOREIGN PATENT DOCUMENTS

| | | |
|---|---|---|
| 323967 | 1/1930 | United Kingdom . |
| 1385635 | 2/1975 | United Kingdom . |
| 1395169 | 5/1975 | United Kingdom . |
| 2008834A | 6/1979 | United Kingdom . |

*Primary Examiner*—Reinaldo P. Machado
*Assistant Examiner*—Alvin Chin-Shue
*Attorney, Agent, or Firm*—Harness, Dickey & Pierce

[57] ABSTRACT

A wind-resistant sign and stand apparatus is disclosed and generally includes a base assembly for supporting a sign panel protruding generally outwardly therefrom. The base assembly includes one or more flexible and resilient based members retained in a generally bow-shaped arcuate configuration. The base members are adapted to further deflect in response to wind or other loads in order to substantially prevent the sign and stand apparatus from tipping over.

20 Claims, 7 Drawing Figures

PORTABLE WIND-RESISTANT SIGN STAND WITH FLEXIBLE BOW-TYPE LEGS

BACKGROUND AND SUMMARY OF THE INVENTION

The present invention relates to sign and poster display devices of all kinds. The invention more particularly relates to a wind-resistant portable sign and stand apparatus having a flexible and resilient base assembly.

Numerous sign stands and poster display devices known today are used for displaying various signs and messages for conveying advertisements and information to the public. In many of such sign and stand apparatuses, the signs are typically positioned on sign standards or posts that are anchored in the ground, held in place by sandbags or other heavy objects, or spring-mounted on bases which allow them bend or deflect without tipping over under high wind forces. Spring-mounted sign stands which can be used for this purpose are shown in U.S. Pat. Nos. 3,646,696; 3,662,482; 4,033,536; 4,265,040; and 4,288,053; as well as in copending patent applications, Ser. Nos. 274,400, filed June 17, 1981; 442,378, filed Nov. 17, 1982; 442,418, filed Nov. 17, 1982; and 442,419, filed Nov. 17, 1982. All of said copending applications are assigned to the same assignee as the invention herein, and their disclosures are hereby incorporated by reference herein. Such deflectable sign stands, although unanchored and lightweight, prevent tipping over or sliding of the sign and stand units in virtually all weather and wind conditions.

Although the above-described sign and sign stand units are well-adapted for a variety of sign or display applications, it is an object of the present invention to provide a durable, portable and wind-resistant sign and stand apparatus that is even lighter in weight and less expensive to manufacture than many of the previous sign and stand units. It is another object of the invention to provide such a sign stand which employs a minimum number of parts or components, and that can be disassembled into a flat configuration for ease of transportation and storage. A still further object is to provide a sign and stand apparatus that is aesthetically-pleasing and inexpensive to manufacture and which has sufficient durability and wind resistance to be used in many different applications, including construction sites, pedestrian or vehicular traffic messages or barriers, commercial advertisements, and the like.

In accordance with the present invention, an improved wind-resistant sign and stand apparatus generally includes a base assembly and a sign panel protruding in a generally outward vertical direction from the base assembly to be supported preferably in a transverse relationship therewith. The base assembly includes one or more longitudinally-extending base members that are flexible and resilient, mounting means for securing the sign panel to the base assembly, and retainer means for retaining the base members in a resiliently flexed condition or configuration. The base members are sufficiently flexible and resilient to further deflect in response to loads such as wind forces exerted in directions generally transverse to the sign panel. In a preferred embodiment of the invention, the sign panel is removably clamped to the base assembly, and the base member and retainer means are disconnectible, such that the sign and stand apparatus may be dissassembled into a substantially flat configuration for ease of transportation and storage. The mounting means preferably includes apparatus for guidingly inserting the sign panel between a pair of members that are adapted to clampingly engage opposite sides or faces of the sign panel in order to allow the apparatus to be quickly and easily erected.

Additional objects, advantages and features of the present invention will become apparent from the following description and appended claims, taken in conjunction with the accompanying drawings.

DETAILED DESCRIPTION OF THE PREFERRED EMBODIMENTS

Figure 1:
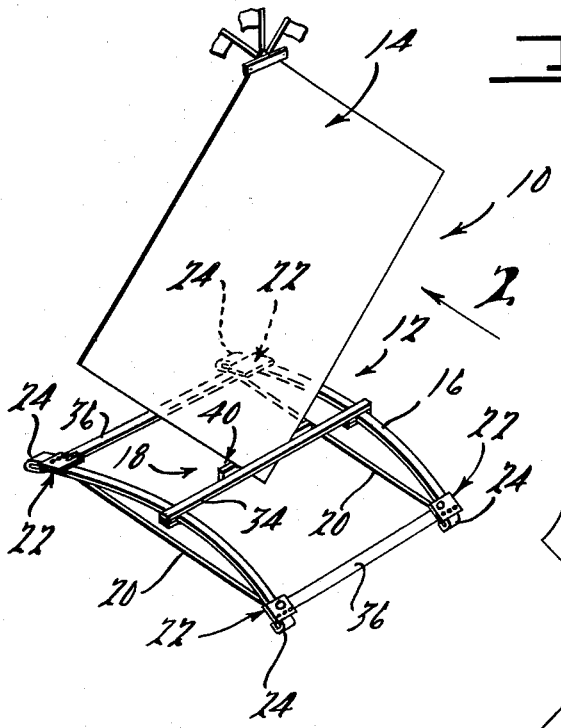
FIG. 1 is a perspective view of an exemplary sign and stand apparatus in accordance with the present invention.
Figure 2:
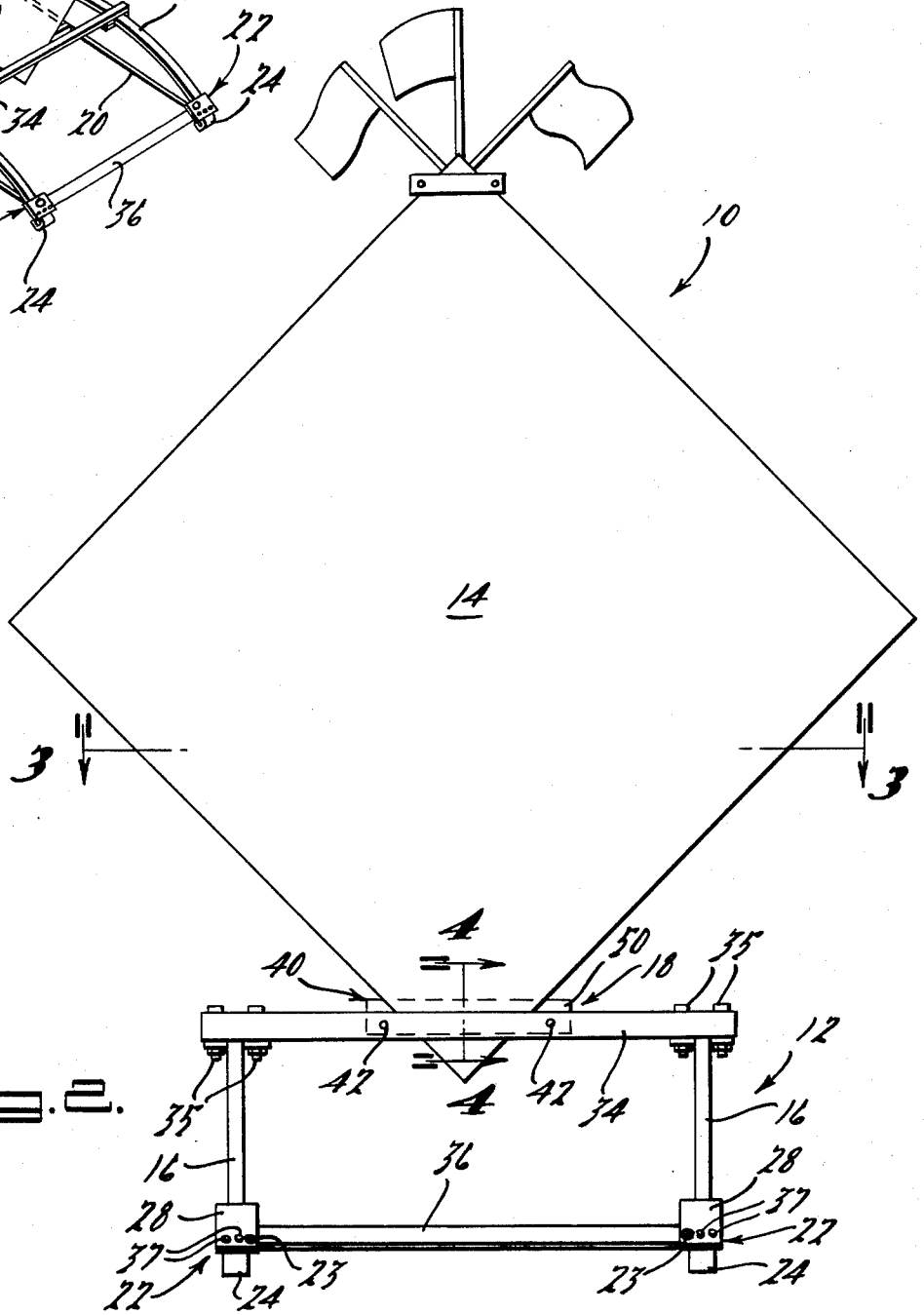
FIG. 2 is an elevation view looking in the direction of arrow 2 of FIG. 1.
Figure 3:
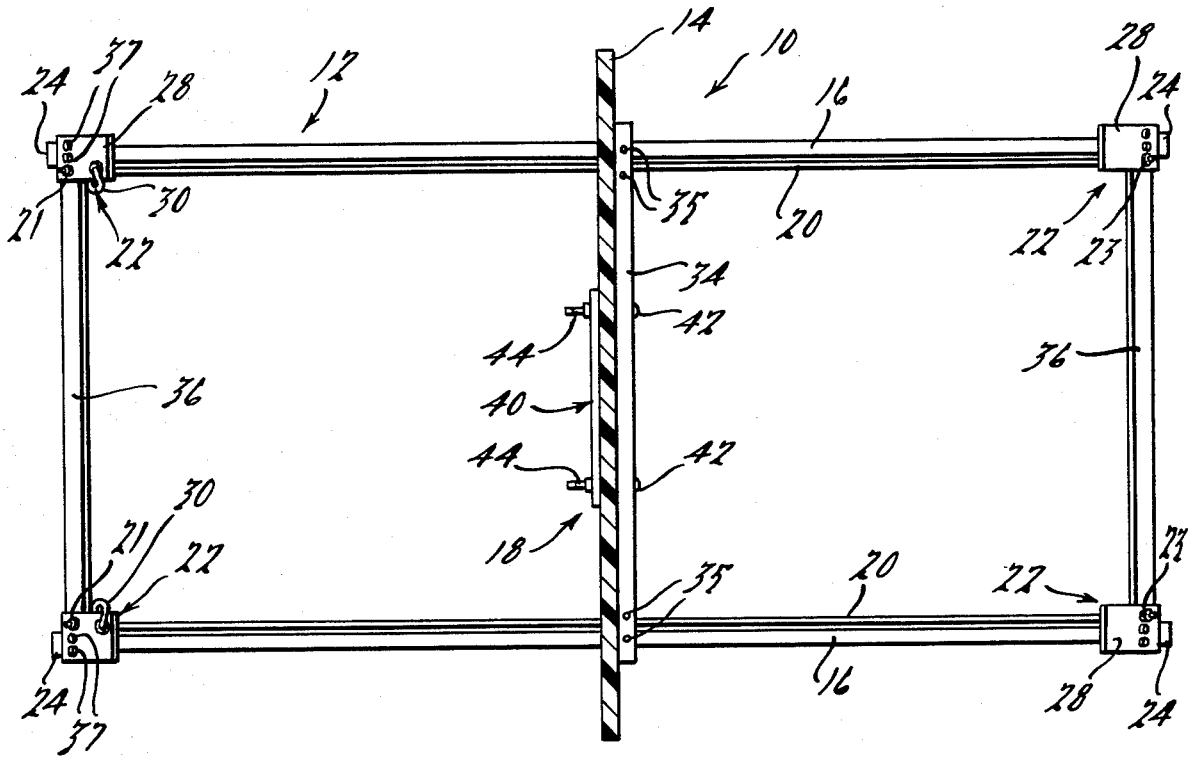
FIG. 3 is a top view, partially in cross-section, taken along line 3—3 of FIG. 2.

FIGS. 1 through 7 illustrate an exemplary embodiment of a wind-resistant sign and stand apparatus in accordance with the present invention. One skilled in the art will readily recognize from the following discussion that the principles of the present invention are equally applicable to sign and stand units other than that shown for purposes of illustration in the drawings.

As shown in FIG. 1, an exemplary sign and stand apparatus 10 includes a generally longitudinally-extending base assembly 12 and a sign panel 14 protruding in a generally outward and upwardly vertical, direction from the base assembly 12 to be supported thereby. The base assembly 12 includes one or more flexible and resilient base members 16, a mounting assembly 18 for securing the sign panel 14 to the base assembly 12, and a number of interconnecting members 20 adapted for releasably retaining their corresponding or associated base members 16 in a resiliently flexed, generally bow-shaped condition or configuration. As is further explained below, the laterally-spaced and flexed base members 16 are adapted to further resiliently deflect in response to loads, such as wind loads, exerted on the sign and stand apparatus 10 in directions generally transverse to the sign panel 14. Such further deflection substantially prevents the sign and stand apparatus 10 from tipping over in response to said transverse loads. The end portion 22 of the base members 16 are preferably equipped with tips or pods 24, which may be composed of rubber or other non-skid material, to help prevent the sign and stand apparatus 10 from sliding on smooth or hard supporting surfaces. It should be noted that the sign and stand apparatus 10 may be used in any of several varying applications wherein the sign panel 14 protrudes in either a vertical direction, a horizontal direction, or virtually any other direction.

As is further illustrated in FIGS. 2 through 7, the base assembly 12 preferably includes at least a pair of the elongated base members 16, each of which has an associated interconnecting member 20 adapted to limit the maximum distance between the spaced-apart end portions 22 to a predetermined distance. Such predetermined distance is less than the distance between the end portions 22 when the base member is in a relaxed or unflexed condition, thereby retaining the base member in the above-described flexed and generally bow-shaped arcuate configuration or condition.

One skilled in the art will readily recognize that the base members 16 and the interconnecting members 20 may have shapes or configurations other than those shown in the drawings. In the preferred embodiment, however, the base members 16 are elongated and thin in configuration and composed of a fiberglass reinforced plastic material or a similar resilient and flexible material. An example of one suitable material for the base members 16 is fiberglass reinforced plastic pultruded rod or bar stock manufactured by Glasforms Inc. of San Jose, Calif. Such exemplary rod or bar stock has typical properties as listed below:

Ultimate Tensile Strength—120,000 psi min
Ultimate Flexural Strength—120,000 psi min
Ultimate Compressive Strength—70,000 psi min
Modulus of Elasticity—$6.0\times10^6$ psi
Izod Impact Ft.-lb per in—40 min
Dielectric Strength—360 volts/mil min
Dielectric Constant at 60 Hz—6.6
ARC Resistance (ASTM D495)—186 seconds
ARC Resistance—100 KV/Foot-No Damage
Specific Gravity—2.0
Glass Content—76%
Density—0.073 lbs/in$^3$
Water Absorption: Weight increase after 24 hours immersion—0.05%
Thermal Coefficient of Expansion—$3\times10^6$ inches/inch/°F.
Thermal Conductivity—2.1 BTU per sq ft/hr/°/in
Specific Heat—0.24 BTU/lb/°F.

One skilled in the art will readily recognize that other flexible and resilient materials may be substituted for that described above. The types of materials that are suitable for the base members 16 in a given application depends upon such factors as the size, shape and weight of the sign, the length and width of the base assembly, the degree of curvature of the base members when in their flexed, bow-shaped condition, and other factors readily apparent to those skilled in the art.

Each of the interconnecting members 20 preferably comprises an elongated, longitudinally-extending flexible cable, strap or other cable-like member. The members 20 are secured at each of their ends 21 and 23 to one of the end portions 22 of its corresponding base member 16. Each of the preferred interconnecting members 20 also includes an enlargement or protuberance 26 adapted to interferingly engage, and to be retained by, a plate member 28 on the end portion 22 of the corresponding base member 16 when the interconnecting member 20 is inserted within a slot 30 in the plate member 28. Preferably the slots 30 are oriented so that they are open toward the lateral sides of their plate members 28, or so that they open toward the tips or pods 24, in order to prevent the interconnecting members 20 from slipping out of the slots 30 when the base member 16 resiliently deflect as described below.

The protuberances 26 preferably comprise sleeve members that are press-fitted onto the cable-like interconnecting members 20 and are located adjacent the respective opposite ends of the interconnecting members at predetermined positions thereon. The predetermined position of the protuberances 26 are such that when the interconnecting members are received in their respective slots 30, they limit the maximum distance between the end portions 22 to a predetermined maximum distance. Such maximum distance is less than the spacing between the end portions 22 when the base member is in an unflexed condition, and said interconnecting members thereby retain their base members in the above-described generally bow-shaped configuration or condition (see FIG. 5). In the preferred embodiment, the interconnecting cable-like members 20 are secured at such opposite ends to their corresponding plate members 28 or other portions of the base assembly 12 in order to maintain them in the proximity to the corresponding base members even when the protuberances 26 are disengaged from their slots 30. The overall lengths of the interconnecting members are sufficient to allow their corresponding base members 16 to relax when the protuberances 26 are disconnected from the plate members 28 as is described in more detail below.

The base assembly 16 preferably includes a laterally-extending cross-member 34 secured to the base members 16 at a generally intermediate location thereon and one or more laterally-extending end cross-members 36 secured to the base members 16 generally at their end portions 22. The cross-members 34 and 36 maintain the base members 16 in their laterally-spaced relationship and provide lateral support and structural stability for the base assembly. The cross-member 34 is connected to the base member 16 by bolts 35 or other similar connecting means. The end cross-members 36 are secured to the plates 28 and the base member 16 by bolts 37 or other similar or equivalent connecting means.

In the preferred embodiment shown in the drawings, the mounting apparatus 18 includes a generally laterally-extending clamping plate 40 disposed generally adjacent the cross-member 34. The clamping plate 40 and the cross-member 34 are interconnected by threaded fasteners 42 and nuts 44 or other suitable means for selectively forcibly urging the clamping plate 40 and the cross-member 34 toward each other to clampingly anchor and support the sign panel 14 in its outwardly-protruding relationship with the base assembly 12.

Figure 4:
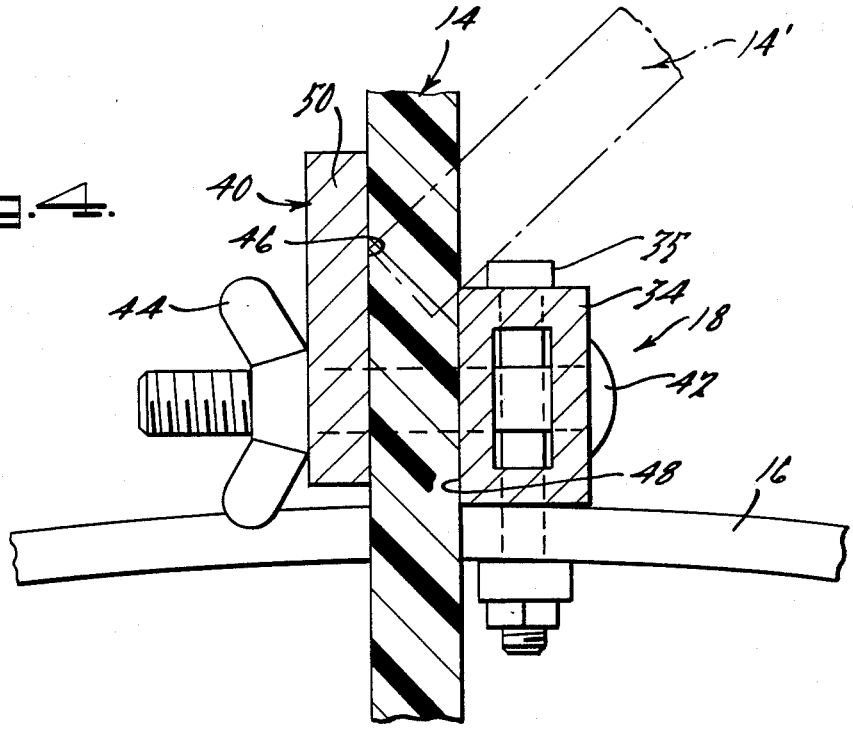
FIG. 4 is a sectional view taken along line 4—4 of FIG. 2.

As shown in FIG. 4, the clamping plate 40 and the cross-member 34 preferably include respective clamping faces 46 and 48 thereon for engaging opposite sides or faces of the sign panel 14 when the sign panel is anchored therebetween. Preferably, the clamping face 46 of the clamping plate 40 extends outwardly beyond the cross-member 34 to form a lip portion 50. The lip portion 50 is adapted to abuttingly guide the sign panel 14 into the space between the clamping plate 40 and the cross-member 34 when the sign panel is slidably inserted therebetween during assembly of the sign and stand apparatus. (A sign panel 14', shown in phantom lines in FIG. 4, is depicted in the process of being inserted in position in the mounting apparatus 18.) Such lip portion 50 therefore facilitates the ease of assembly of the apparatus by substantially eliminating the need to manually hold the clamping plate 40 and the cross-member 34 apart in order to insert the sign panel therebetween. The sign panel can be abutted against the lip portion 50 during assembly in order to urge the clamping plate 40 away from the cross-member 34, and then the sign panel is slidably inserted therebetween while being slidably guided by the clamping face 46. Such an arrangement is especially advantageous in the assembly of large traffic warning or construction site sign and stand apparatuses that may be bulky and may have to be erected quickly.

Figure 5:
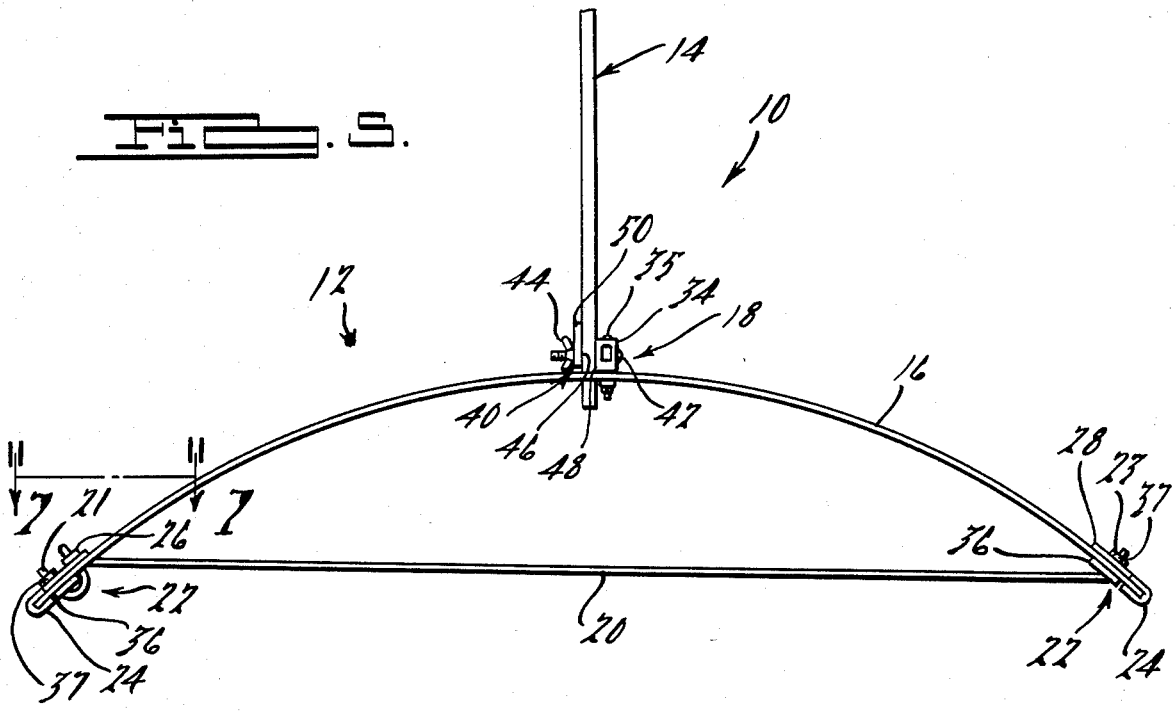
FIG. 5 is a side elevational view of the sign and stand apparatus of FIG. 1.
Figure 6:
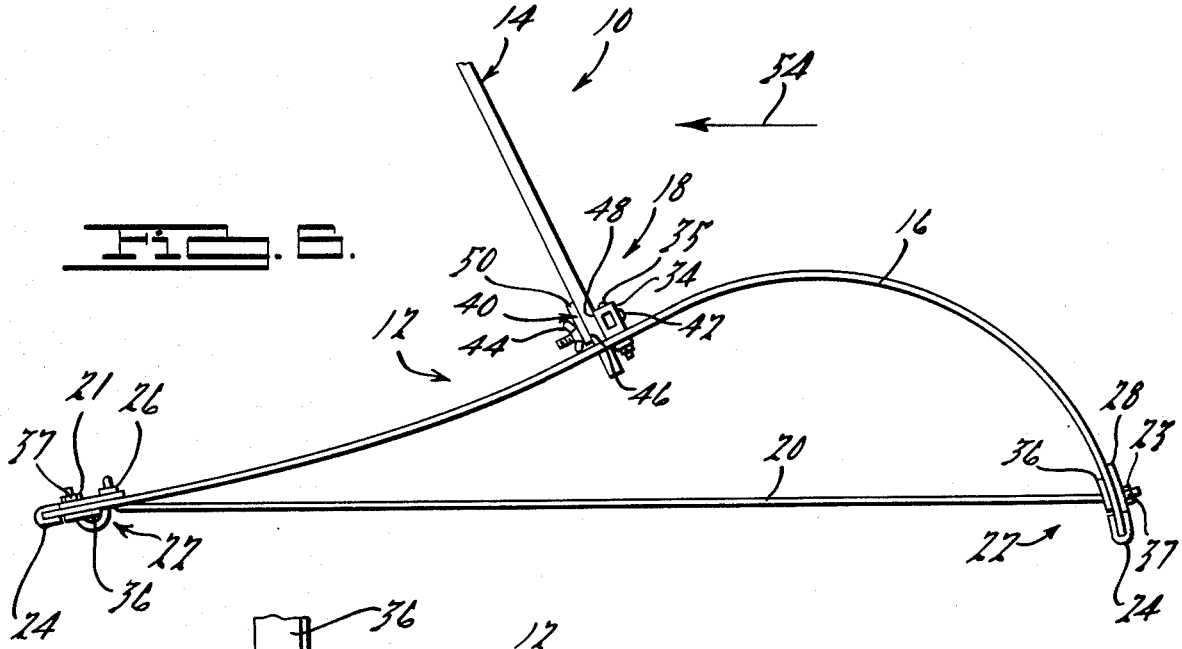
FIG. 6 is a side elevational view similar to that of FIG. 5, but illustrating the base assembly of the sign and stand apparatus in a deflected condition in response to generally transverse loads exerted upon the sign panel.
Figure 7:
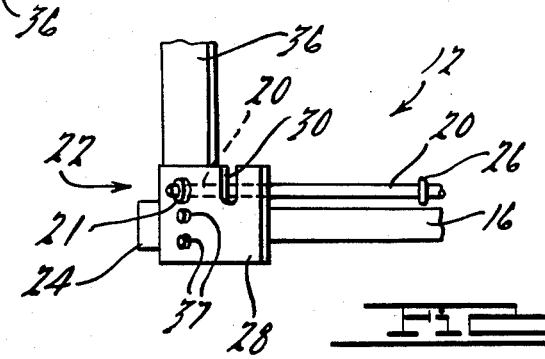
FIG. 7 is an enlarged detail view of a portion of the sign and stand apparatus of FIG. 1, illustrating one of the base members and its associated interconnecting member when said base member is in a relaxed configuration.

As illustrated in FIG. 5, when the sign and stand apparatus 10 is assembled and erected, the base members 16 are in their generally bow-shaped condition or configuration mentioned above and are retained in such outwardly convex, arcuate-shaped configuration by their corresponding interconnecting members 20. Because of their flexibility and resilience, however, the base members 16 are adapted to further resiliently deflect into generally a serpentine condition or configuration, as shown in FIG. 6, in response to loads such as wind forces exerted in a generally transverse direction on the sign panel 14 or on other portions of the sign and stand apparatus 10. In the preferred embodiment, such loads (indicated schematically by reference numeral 54 in FIG. 6) cause the base members 16 to further resiliently deflect into a generally sinusoidal-shaped configuration wherein the base members 16 are generally outwardly concave-shaped on one side, and generally outwardly convex-shaped on the other side, of the sign panel mounting assembly 18. Such further resilient deflection substantially prevents the sign and stand apparatus from tipping over in response to the transversely-directed loads.

The base members 16 are resiliently biased toward their generally bow-shaped configuration shown in FIG. 5 because of the retention of their end portions 22 by the interconnecting members 20. Therefore, when the wind or other loads 54 subside or are removed, the base members 16 resiliently return to their bow-shaped conditions and thus return the sign panel to its original outwardly-protruding orientation. Also, due to the construction of the inventive sign stand, the invention performs the same regardless of the direction of the wind forces. It is estimated that the sign stand will remain upright without tipping over or sliding along the ground in wind forces in excess of 50 m.p.h.

Finally, as discussed above and shown in FIG. 7, the interconnecting members 20 preferably have one end 21 connected to the base assembly generally at one of the end portions 22 of their corresponding base members 16, and the opposite end 23 of the interconnecting members 20 is preferably connected to the opposite end portion 22. The protuberances 26 are located generally adjacent one end of their interconnecting members at a predetermined position such that when the protuberances are interferingly engaged with the slots 30 on the corresponding plate members 28, the base members are urged into the above-described generally bow-shaped configurations. The lengths of the interconnecting members 20 are preferably sufficient to allow the base members to relax into a substantially flat condition when the protuberances 26 are disconnected from the plate members 28, thereby facilitating convenient storage and transporation of the disassembled sign and stand apparatus.

The foregoing discussion discloses and described exemplary embodiments of the present invention. One skilled in the art will readily recognize from such discussion that various changes, modifications and variations may be made therein without departing from the spirit and scope of the invention as defined in the following claims.

What is claimed is:

1. In a sign and stand apparatus having a sign panel protruding in a generally outward direction from an unanchored and readily portable base assembly, said sign panel being supported by said base assembly, the improvement wherein said base assembly includes at least one base member which is flexible and resilient in bending, mounting means for securing said sign panel to said base assembly, and retainer means for releasably engaging said base member to cause said base member to be resiliently and bendably deflected from an unflexed condition to a resiliently flexed generally arcuate bow-shaped condition, said flexed and generally bow-shaped base member being adapted to further resiliently deflect in response to loads exerted on said sign and stand apparatus in directions generally transverse to said sign panel in order to substantially prevent said sign and stand apparatus from tipping over in response to said transverse loads.

2. The improvement according to claim 1, wherein said retainer means comprises an interconnecting member connectible with said base member generally at spaced-apart portions thereon, said interconnecting member being relatively inextensible in order to limit the maximum distance between said spaced-apart portions to a predetermined maximum distance when said base member is in said flexed bow-shaped condition, said predetermined maximum distance being less than the spacing between said spaced apart portions when said base member is in an unflexed condition.

3. The improvement according to claim 2, wherein said interconnecting member is elongated in configuration and includes a portion thereof that is releasably connectible to one of said spaced-apart portions of said base member in order to retain said base member in said flexed and generally bow-shaped condition, said portion of said interconnecting member also being disconnectible from said base member in order to allow the resilient base member to relax into said unflexed condition.

4. The improvement according to claim 1, wherein said base member is in a generally bowed-shaped configuration when in said flexed condition and is in a generally flat configuration when in said unflexed condition.

5. The improvement according to claim 4, wherein said flexed bow-shaped base member is adapted to further resiliently deflect into a generally serpentine-shaped configuration in response to said transverse loads.

6. The improvement according to claim 5, wherein said mounting means is secured to said base member at a generally intermediate location thereon, said base member being resiliently deflectable in response to said transverse loads such that said base member is outwardly concave on one side of said mounting means and outwardly convex on the opposite side of said mounting means when in said serpentine-shaped configuration.

7. The improvement according to claim 6, wherein said base assembly includes a pair of laterally spaced-apart generally elongated base members, each of said base members having opposite end portions thereon and one of said retainer means associated therewith, said retainer means each including an elongated interconnecting cable-like member connectible with said base member generally at said end portions, each of said interconnecting member having a protuberance thereon at a location between said end portions, said protuberance being releasably engageable with one of said end portions to limit the maximum distance between said end portions of their associated base members to said predetermined maximum distance when said base members are in either of said bow-shaped or said generally serpentine configurations.

8. In a sign and stand apparatus having a sign panel protruding in a generally outward direction from an unanchored base assembly, the improvement wherein said base assembly includes at least one longitudinally-extending base member which is flexible and resilient in bending but relatively inextensible longitudinally, said base member having opposite end portions thereon, mounting means connected to said base member at a generally intermediate location thereon for securing said sign panel thereto, and longitudinally-extending interconnecting member for releasably interconnecting said end portions of said base member in order to bendably deflect and retain said base member in a resiliently flexed and generally bow-shaped configuration, said base member being further deflectable from said bow-shaped configuration into a generally serpentine configuration in response to loads exerted on said sign and stand apparatus in directions generally transverse to said sign panel in order to substantially prevent said sign and stand apparatus from tipping over in response to said transverse loads.

9. The improvement according to claim 8, wherein said base assembly includes a pair of said longitudinally-extending base members laterally spaced from one another and a pair of said interconnecting members corresponding to said pair of base members.

10. The improvement according to claim 9, wherein each of said base members has at least one of its end portions selectively connectible with its corresponding interconnecting member at a predetermined position thereon in order to retain said base member in said generally bowed configuration, said base member also being selectively disconnectible from said corresponding interconnecting member in order to allow said base member to resiliently assume a generally relaxed configuration.

11. The improvement according to claim 9, wherein said base assembly further includes at least one cross-member extending generally laterally between said base members and being secured thereto at said generally intermediate locations, said cross-member having said mounting means thereon, said mounting means including at least one laterally-extending clamping plate generally adjacent said cross-member, and means for urging said clamping plate and said cross-member toward one another in order to clampingly anchor and support said sign panel therebetween in said outwardly protuding relationship with said base assembly.

12. The improvement according to claim 11, wherein said clamping plate and said cross-member each include a clamping face thereon, said clamping faces being adapted to engage opposite faces on said sign panel in a substantially flat relationship therewith when said panel is clamping anchored therebetween, said clamping face on said clamping member extending outwardly beyond said clamping face of said cross-member in order to guide said signal panel into the space between the clamping member and the cross-member as said sign panel is inserted therein.

13. The improvement according to claim 9, wherein said interconnecting members each comprise a cable-like member having a first of its cable ends secured to one of the end portions of the corresponding base member, said cable-like member further having a protuberance generally adjacent but spaced from a second opposite cable end, said base assembly including attachment means generally adjacent the opposite end of said corresponding base member for interferingly engaging and retaining said protuberance, said cable-like member being adapted to retain said corresponding base member in said flexed bow-shaped configuration when said protuberance and said attachment means are in said interfering engagment.

14. The improvement according to claim 13, wherein said attachment means includes slot means for receiving said cable-like member therein and for interferingly engaging said protuberance on said cable-like member.

15. The improvement according to claim 13, wherein said protuberance is generally adjacent to but spaced from said second opposite cable end of said cable-like member, said opposite cable end of said cable-like member being secured to said base assembly generally adjacent said opposite end of said corresponding base member, each of said cable-like members being of a sufficient length to allow its corresponding base member to relax to an unflexed configuration when said protuberance is disengaged from said attachment means.

16. A sign and stand assembly, comprising a laterally-extending sign panel, a base assembly for supporting said sign panel in a generally outwardly protruding relationship therewith, said base assembly including at least a pair of generally longitudinally-extending resilient and bendably flexible base members laterally spaced from one another, each of said base members having ground-engaging end portions thereon, at least one laterally extending cross-member secured to said base members at longitudinally intermediate locations thereon, said cross-member including a clamping member attached thereto and means for selectively urging said clamping member toward said cross-member in order to clampingly engage at least a portion of said sign panel therebetween, at least a portion of said clamping member extending generally outwardly beyond said cross-member in order to slidingly guide said sign panel into a space between said clamping member and said cross-member as said sign panel is inserted therein, an interconnecting member associated with each of said base members, each of said interconnecting members having one end secured to one of the end portions of its corresponding base members and having means generally adjacent but spaced from the opposite end of said interconnecting member adapted to be releasably connected to the opposite end portion of said corresponding base member in order to resiliently and bendably flex said corresponding base member into a generally outwardly curving arcuate configuration, said base members being adapted to further bendably and resiliently deflect into a generally serpentine configuration at least in response to loads exerted on said sign panel in directions generally transverse thereto in order to substantially prevent said stand and apparatus from tipping over under the influence of said loads.

17. A sign and stand assembly according to claim 16, wherein each of said interconnecting members comprises a cable-like member having a protuberance spaced from said opposite end thereof, said base assembly including slot means generally adjacent said opposite end portion of each of said base members, each of said slot means being adapted to receive said cable-like member therein and to interferingly engage said protuberance on said corresponding cable-like member, said opposite end of each of said cable-like members being secured to said base assembly generally adjacent said opposite end portion of its corresponding base member, each of said cable-like members being of a sufficient length to allow its corresponding base member to relax to an unflexed configuration when said protuberance is disengaged from said slot means.

18. A sign and stand assembly according to claim 17, wherein said base assembly further includes a pair of end cross-members extending laterally between and secured to said base members generally adjacent the end portions thereof.

19. A sign and stand assembly according to claim 18, wherein each of said ground-engaging end portions of said base members includes non-skid means thereon.

20. A sign and stand assembly according to claim 18, wherein said base members are composed of a fiberglass reinforced plastic material.

* * * * *

UNITED STATES PATENT AND TRADEMARK OFFICE

CERTIFICATE OF CORRECTION

PATENT NO. : 4,509,714

DATED : April 9, 1985

INVENTOR(S) : James R. Seely

It is certified that error appears in the above-identified patent and that said Letters Patent is hereby corrected as shown below:

Column 4, line 21, "the" (first occurrence) should be --close--

Column 6, line 41, Claim 3, "the" should be --said--

Column 7, line 62, Claim 12, Insert --sign-- before "panel"

Column 7, line 63, Claim 12, "clamping", first occurrence, should be -- clampingly --.

Column 7, line 66, Claim 12, "signal" should be --sign--

Signed and Sealed this

*Twelfth* Day of *November 1985*

[SEAL]

*Attest:*

*Attesting Officer*

DONALD J. QUIGG

*Commissioner of Patents and Trademarks*